United States Patent [19]

Horiki et al.

[11] Patent Number: 4,909,120

[45] Date of Patent: Mar. 20, 1990

[54] ELECTRONIC MUSICAL INSTRUMENT

[75] Inventors: Masamichi Horiki; Tsutomu Saito, both of Shizuoka, Japan

[73] Assignee: Kabushiki Kaisha Kawai Gakki Seisakusho, Shizuoka, Japan

[21] Appl. No.: 239,190

[22] Filed: Aug. 31, 1988

[30] Foreign Application Priority Data

Sep. 29, 1987 [JP] Japan ..... 62-245577

[51] Int. Cl.[4] ..... G10H 1/02; G10H 1/00; G10H 3/00

[52] U.S. Cl. ..... 84/627; 84/663

[58] Field of Search ..... 84/1.26, 1.13, 1.61, 84/1.19, 1.27, 1.24

[56] References Cited

U.S. PATENT DOCUMENTS 3,882,751 5/1975 Tomisawa et al. ..... 84/1.13 X
4,079,650 3/1978 Deutsch et al. ..... 84/1.13 X
4,161,128 7/1979 Yamada et al. ..... 84/1.13 X
4,178,826 12/1979 Hiyoshi et al. ..... 84/1.26
4,292,873 10/1981 Okumura et al. ..... 84/1.13 X
4,357,849 11/1982 Ezawa et al. ..... 84/1.26 X

*Primary Examiner*—A. T. Grimley
*Assistant Examiner*—Matthew S. Smith
*Attorney, Agent, or Firm*—McGlew & Tuttle

[57] ABSTRACT

Truncate processing is performed so that a new tone is not generated before the envelope waveform is finished but the new tone is produced after the volume of the previous tone is sufficiently diminished, by which the new tone can be produced with a satisfactory feeling of attack. Further, the envelope waveform is not abruptly interrupted and cleared in a moment but is decayed at a constant and high speed, thereby preventing the generation of noise such as a click. Moreover, demanded speed data is provided for each tone, by which it is possible to produce repective tones not at a demanded speed like the least common multiple but at an optimum speed for each tone and to make the previous tone generation proceed to the next tone generation without producing noise such as a click.

2 Claims, 8 Drawing Sheets

PHASE
0
SPD
PEP
7/4
DEMSPD
DEMPEP

KEY ON/OFF
NOTE
22
HIGH SPEED RELEASE REQUEST SIGNAL
KON
DEM
φDS
23
PREDETERMINED PHASE END VALUE (PEP)
PHASE COUNTER
CRS
φPC
24
SPEED (SPD) DEMANDED SPEED (DSP)
ACCUMULATOR
φAC
SACC

FIG. 6A
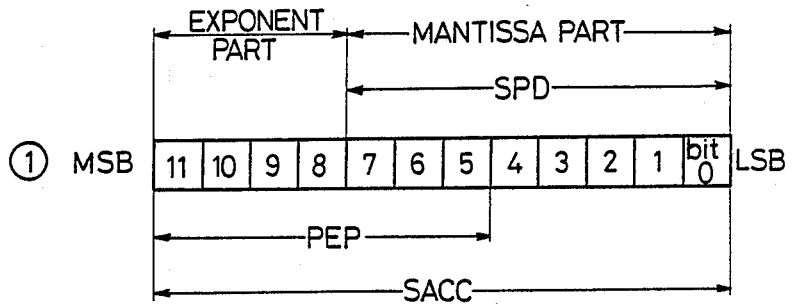
2
| ACCUMULATED VALUE (SACC) | dB |
|---|---|
| FFFh | −0dB |
| F00h | −6dB |
| E00h | −12dB |
| ⋮ | ⋮ |
| 000h | −∞ |
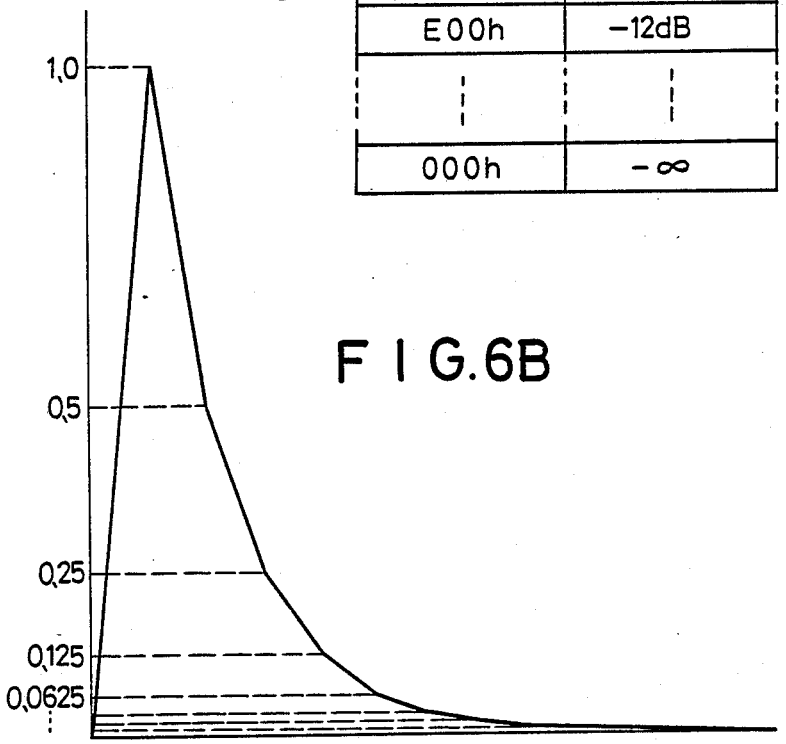
FIG. 6B

ELECTRONIC MUSICAL INSTRUMENT

BACKGROUND OF THE INVENTION

1. Field of the Invention

The present invention relates to an electronic musical instrument which utilizes a system for assigning newly depressed key data to a selected one of all musical tone generating channels when they are being assigned with previously depressed key data and which is further provided with an envelope generator for producing an envelope through phase splitting.

2. Description of the Prior Art

Heretofore there has been proposed an electronic musical instrument which is equipped with an assignor system by which when the number of keys depressed at a time is greater than the number of musical tone generating channels, data of the most recently depressed key is assigned to any one of the channels so as to create an intended musical tone. Such an electronic musical instrument is designed so that where a new key depression occurs when all the channels are being assigned with data of previously depressed keys, truncate processing is conducted by which (I) the assignment of data of that one of the depressed keys which was released earlier than any others is terminated and the newly depressed key data is assigned to that channel, or (II) where all the channels are being assigned with data of keys still depressed, the assignment of data of that one of the depressed keys which was depressed earlier than any others is terminated and the newly depressed key data is assigned to that channel.

In the case (I), however, (A) an attack envelope of the tone of the newly assigned key (hereinafter referred to simply as a new tone) rises before a release envelope of the tone of the previously assigned key (hereinafter referred to simply as a previous tone) is completely finished as shown in FIG. 10A, with the result that no sufficient feeling of attack can be created for the new tone. (B) A solution to this problem, suggested so far, is a method by which when the new tone is developed, the release envelope of the previous tone is immediately cleared to the zero level to permit the attack envelope of the new tone to rise up from the zero level to thereby produce the new tone with a satisfactory feeling of attack. However, this method is not preferable in that a click is generated when the release envelope of the previous tone is cleared to the zero level. Further, there have been suggested two methods (C) and (D) shown in FIG. 10B, but these methods also encounter the same problems as mentioned above.

To obviate the above-mentioned defect of the method (B) in the case (I), it has been proposed to decay or release the envelope of the previous tone at high speed instead of clearing it. In the prior art, however, only one kind of parameter data for such high-speed release is prepared for one electronic musical instrument, and hence is always used no matter what timbre is selected. It is evident, however, it is preferable, for faithful tone reproduction, to set optimum parameter data for each timbre selected.

Moreover, the conventional electronic musical instrument performs the high-speed release in a channel in which the key previously assigned to the channel has been released; in the afore-mentioned case (II), the high-speed release takes place after forcibly releasing the previously assigned key. This will inevitably increase the number of programs used, complicate them, and increase the processing time involved in the case of employing an assignor including a microcomputer or the like, and introduce complexity in the circuit arrangement in the case of using an assignor formed by logic hardware.

SUMMARY OF THE INVENTION

It is therefore an object of the present invention to provide an electronic musical instrument which is provided with a phase splitting type envelope generator by which, in the case of performing the truncate processing for erasing a previous tone and creating a new tone in the same channel, an optimum high-speed release signal is produced for each timbre to thereby ensure the generation of the new tone with a satisfactory feeling of attack, without producing any click.

To attain the above objective, the phase splitting type envelope generator of the electronic musical instrument according to the present invention includes a high speed release demand signal generator which, when a new tone is assigned to a channel in operation for producing a previous tone, generates a high-speed release demand signal, switches speed data in the phase of the previous tone to demanded speed data of the same phase, releases the envelope of the previous tone at such a high speed as not to generate a click and, when it is detected that the level of the envelope of the previous tone has dropped below a demanded predetermined phase end value, turns OFF the high-speed release demand signal, and a phase counter whereby the phase of producing the previous tone is made to proceed to a phase in which to initiate the attack of the new tone when the high-speed release demand signal is turned OFF.

Other objects, features and advantages of the present invention will become more apparent from the following description taken in conjunction with the accompanying drawings.

BRIEF DESCRIPTION OF THE DRAWINGS

FIGS. 6A and 6B show the structure and waveform of envelope data;

DESCRIPTION OF THE PREFERRED EMBODIMENTS

Figures 1A, 1B:
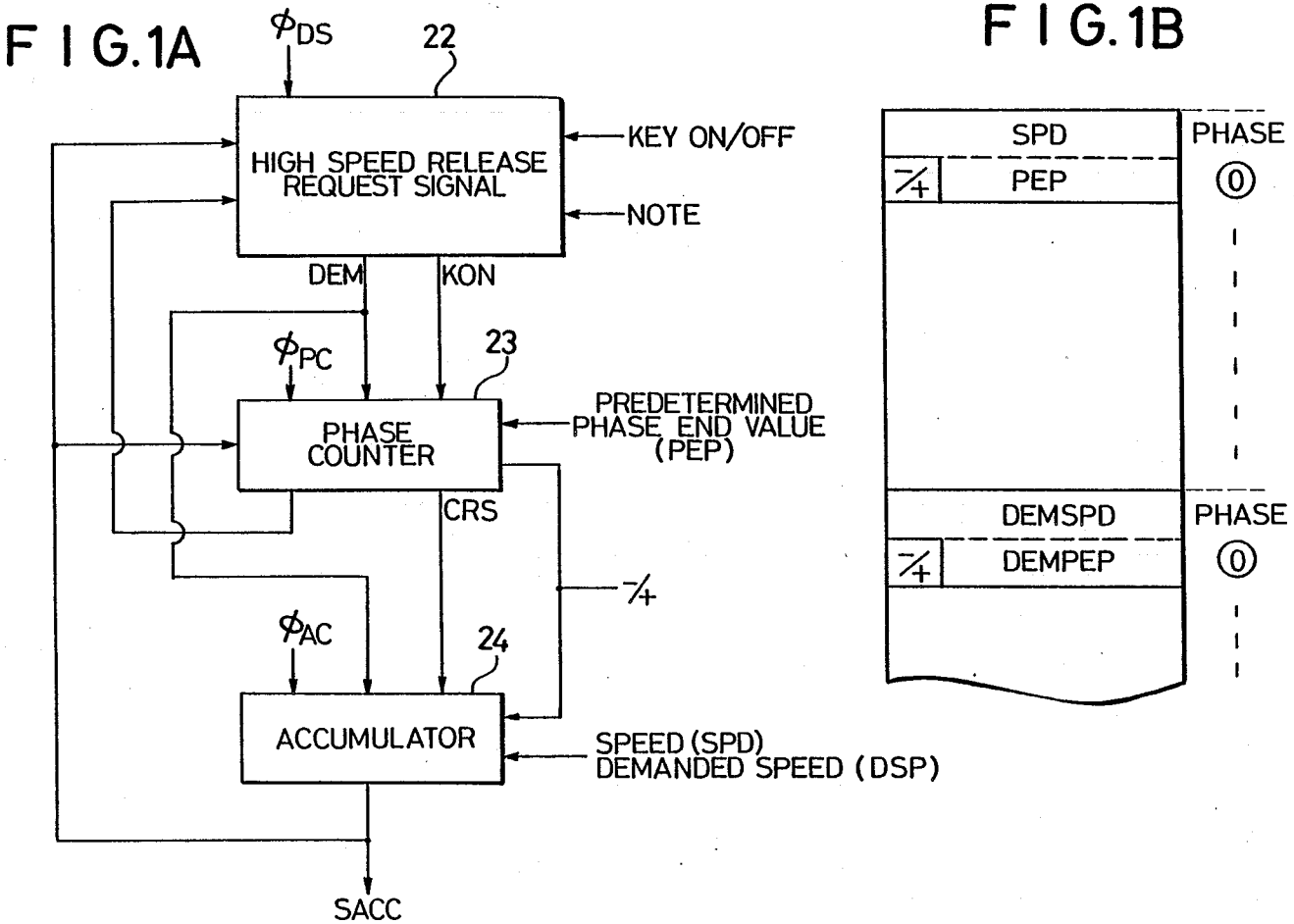
FIGS. 1A and 1B are diagrams, for explaining the principle of the present invention.

In the present invention, an envelope is generated by phase splitting. As shown in FIG. 1B, there are prestored in a memory, for each timbre to be produced, previous phase data composed of speed data (SPD) and predetermined phase end value (PEP) for each phase and new phase data composed of demanded speed data (DEMSPD) and demanded predetermined speed data end value (DEMPEP) for each phase. When a new tone is to be assigned to a high-speed release demand signal generator 22 in FIG. 1A, a phase counter 23 switches the previous phase data to the new phase data and the high-speed release demand signal generator 23 generates, in association with the phase counter 23, a high-speed release demand signal, by which the envelope of a previous tone is released at such a high speed as not to produce a click. The high-speed release demand signal is turned OFF when the envelope level has dropped below the demanded predetermined end value. Data of each phase to the end of the high-speed release is accumulated by an accumulator 24, from which the accumulated output is provided as envelope data (SACC).

In the manner described above, the envelope of the previous tone is released at such a high speed as not to produce a click, after which the attack of the new tone is initiated, thereby making it possible to generate an envelope with a satisfactory feeling of attack.

Figure 2:
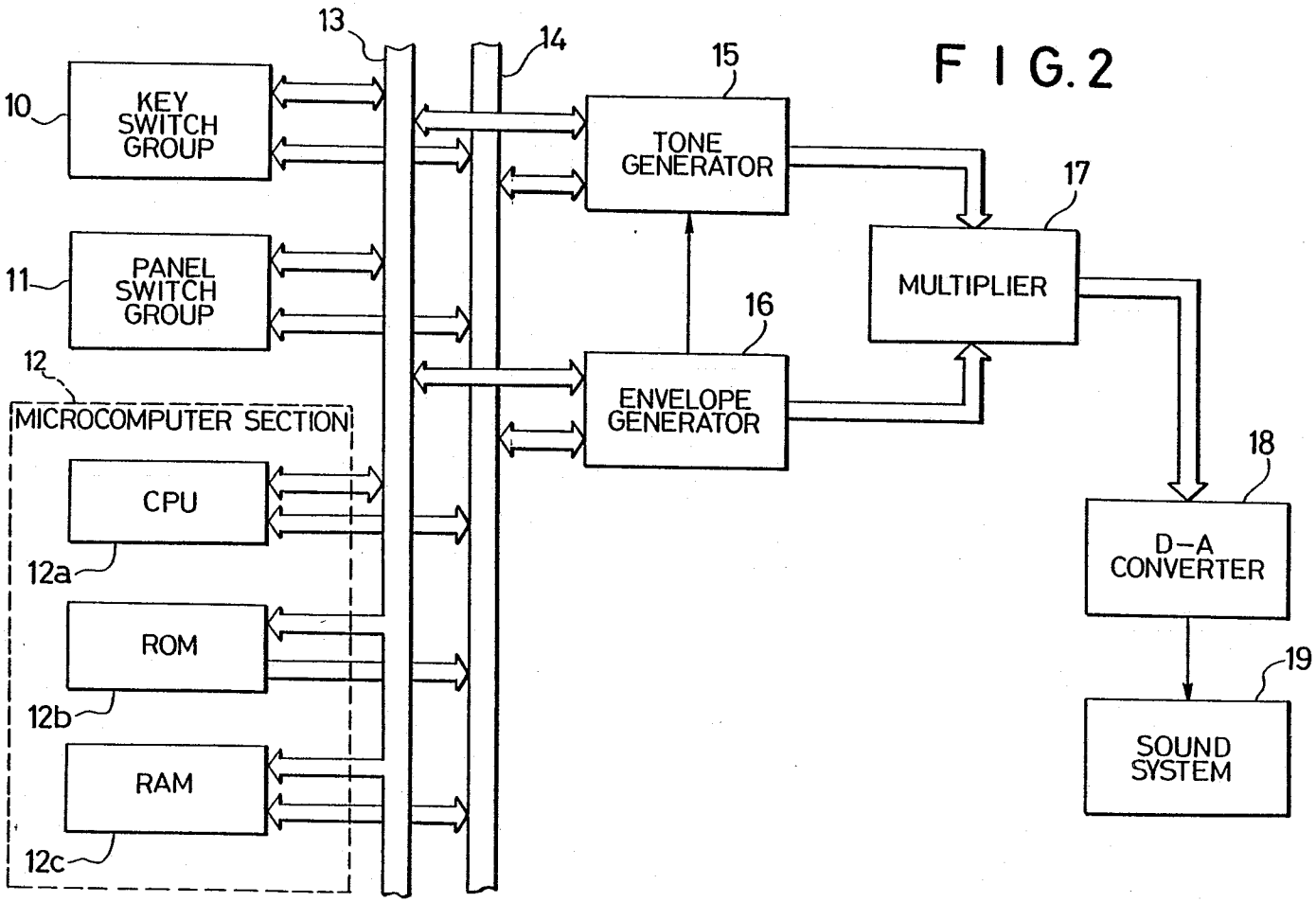
FIG. 2 is a block diagram illustrating the system configuration of the present invention.

FIG. 2 illustrates in block form an embodiment of the electronic musical instrument according to the present invention. The electronic musical instrument comprises: a key switch group 10 composed of a plurality of keys; a panel switch group 11 composed of a plurality of actuators for selecting tone-effect switches; a microcomputer section 12 which detects the states of the key switch group 10 and the panel switch group 11 and yields key data and panel data; a tone generator 15 which generates a musical waveform signal based on the above-said data; an envelope generator 16 which generates an envelope signal for imparting temporal volume variations to a musical waveform to be generated; a multiplier 17 for multiplying the musical waveform signal and the envelope signal; a D-A converter by which digital data from the multiplier 17 is converted into an analog signal; and a sound system 19 by which the musical tone provided in analog form from the D-A converter 18 is amplified and then reproduced via a speaker.

In response to a key switch scan signal which is provided via an address bus 13 from a CPU 12*a* in the microcomputer section 12 the key switch group 10 supplies a state signal of each key to the CPU 12*a* via a data bus 14. The panel switch group 11 provides a selected tone-effect or other state signal via the data bus 14 to the CPU 12*a* in response to a panel switch scan signal provided therefrom via the address bus 13.

The microcomputer section 12 includes the CPU 12*a*, a ROM 12*b* for storing programs, and a RAM 12*c* which temporarily stores data necessary for executing a program and performs the function of a working memory. The RAM 12*c* further includes TONE and DEMTONE areas described later, which are accessed by various control signals of the CPU 12*a* on a time-shared basis.

Figure 3:
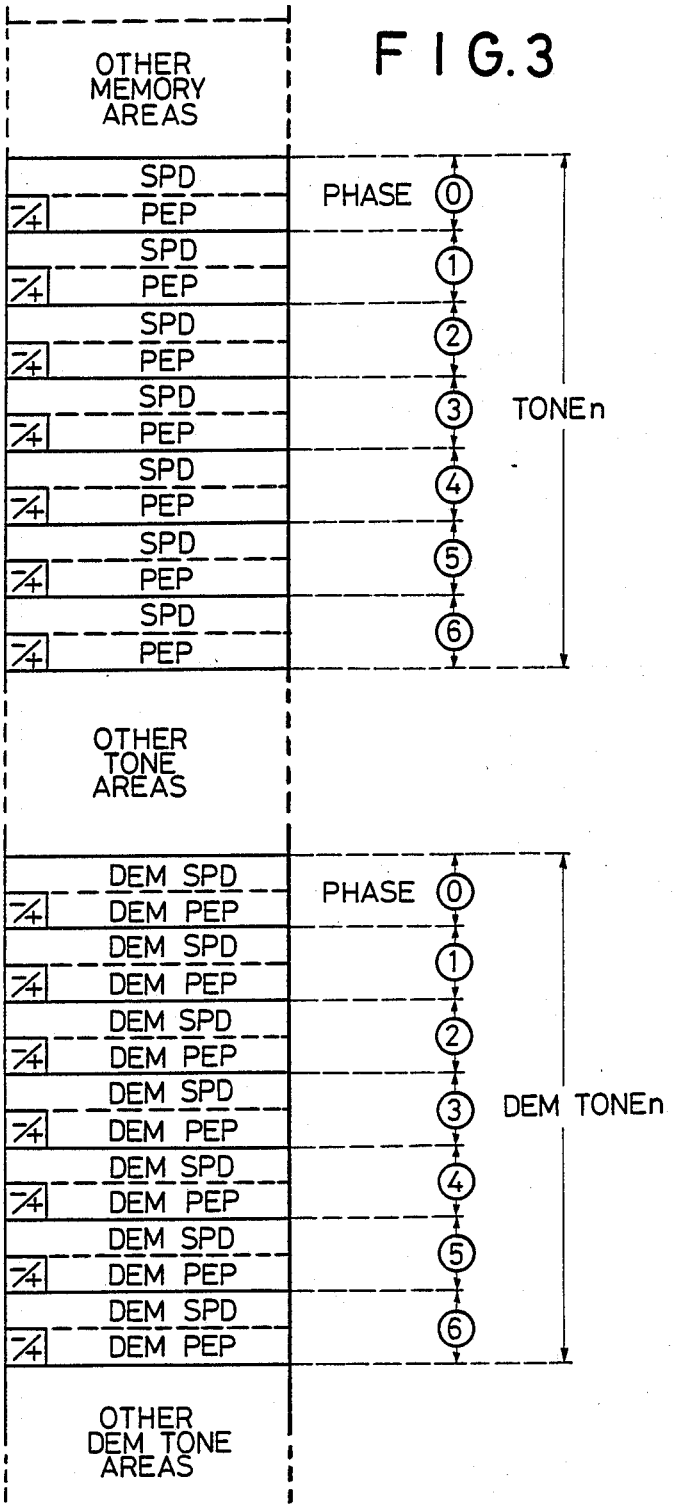
FIGS. 3 and 5 show memory arrangements for use in the present invention.

The envelope generator 16 is such a phase splitting type envelope as disclosed in Japanese Pat. Pub. Disc. No. 198,499/82, for example. In the present invention the envelope generator 16 splits the phase of envelope into four phases (0) to (3) during a KEY-ON period described later and three phases (4) to (6) during a KEY-OFF period also described later. As depicted in FIG. 3, the above-mentioned RAM 12*c* includes TONE and DEMTONE areas for each tone. The data structure of each tone TONEn is composed of such seven phases (0) to (6) as mentioned above. Each phase is composed of 8-bit SPD data, 7-bit phase end value data (hereinafter referred to as PEP data), and 1-bit −/+flag data (hereinafter referred to as a −/+signal) which determines whether the envelope attacks or decays. The −/+signal is a "0" or "1" depending on whether the envelope attacks or decays. The DEMTONE area is composed of demanded speed data (DEMSPD), a demanded −/+signal (DEM−/+), and demanded phase end value data (DEMPEP) for each tone of the TONE area.

Figure 4:
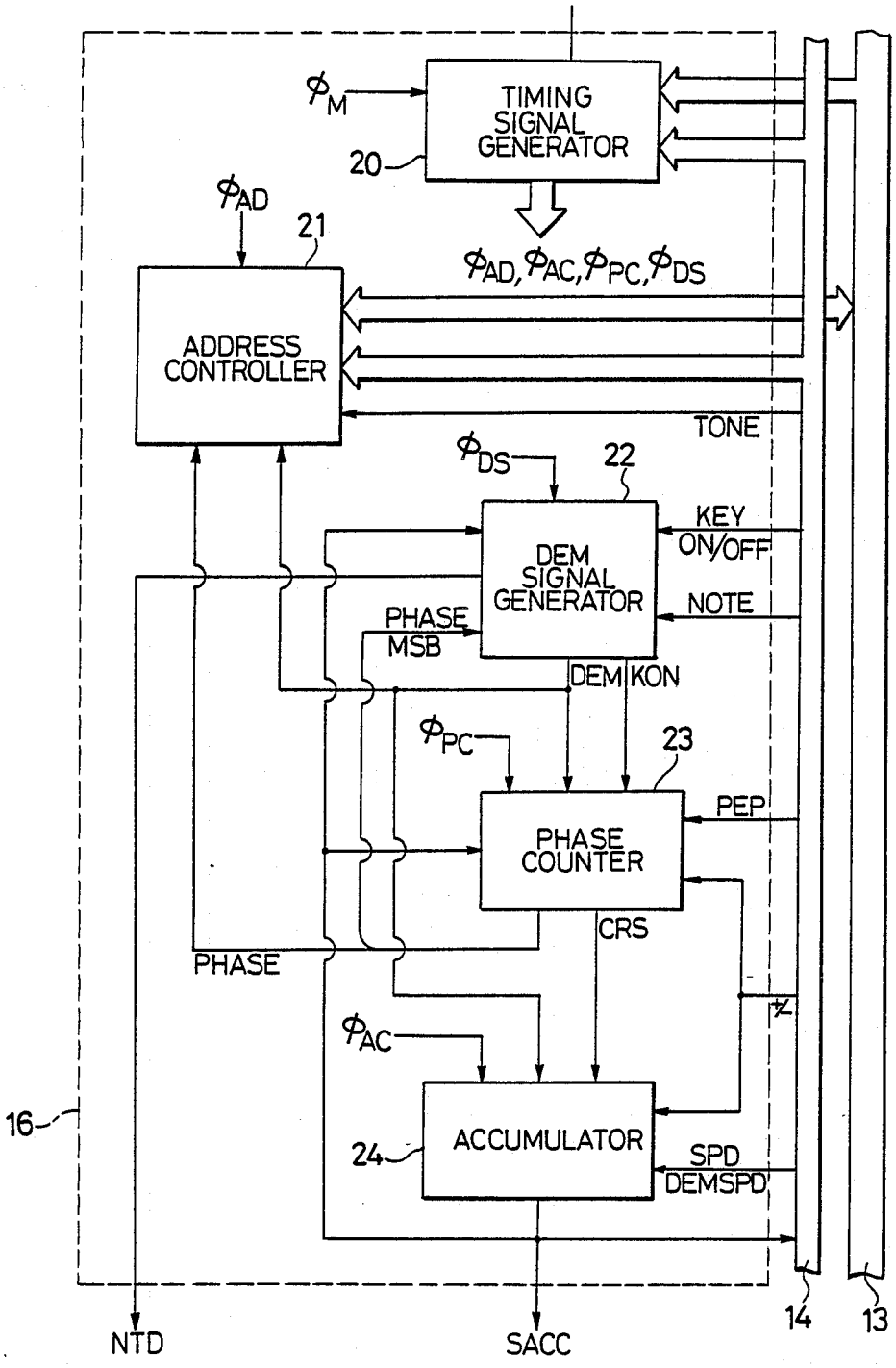
FIG. 4 is a block diagram illustrating the arrangement of the envelope generator of the present invention.

FIG. 4 illustrates in detail the arrangement of the envelope generator 16, which comprises a timing signal generator 20, and address controller 21, a DEM signal generator 22, a phase counter 23, and an accumulator 24 and which is connected to the microcomputer section 12 via the address bus 13 and the data bus 14. The SPD data, the PEP data and the accumulated value of the SPD data (hereinafter referred to as SACC data) bear such relationships as indicated by (1) and (2) in FIG. 6A. The envelope generator 16 conducts floating point arithmetic and the SACC data consists of a 4-bit exponent part and an 8-bit mantissa part. The SPD data consists of an 8-bit mantissa part and, as shown in FIG. 4, it is subjected to an addition or subtraction by the accumulator 24 in the envelope generator 16 in accordance with the −/+signal. The SACC data consists of a 4-bit exponent part and an 8-bit mantissa part. When the −/+signal is a "0", that is, "+", the SPD data is added to the SACC data in a time slot time-divided for each channel. The PEP data corresponds to high-order seven bits of the SACC data and consists of a 4-bit exponent part and 3-bit mantissa part. The PEP data is compared with high-order seven bits of SACC data (four bits in the exponent part and three bits in the mantissa part) in the phase counter 23 of the envelope generator 16. If the SACC data is more than or equal to the PEP data, then the current phase will proceed to the next subsequent phase. On the other hand, when the −/+signal is a "1", that is, "−", the SPD data is subtracted from the SACC data and, as in the case where the −/+signal is "+", the SACC data is compared with the PEP data. If the SACC data is less than or equal to the PEP data, then the current phase will proceed to the next subsequent phase. By this phase shift an envelope waveform is produced. In the accumulator 24 the SPD data is shifted to the left so that it may take an exponential or linear form on a linear axis, depending on whether the −/+signal is a "1" or "0". As a result of this, the envelope is provided in such a form as shown in FIG. 6B.

The above is a brief description of the operation of the envelope generator 16. Next, a detailed description will be given of the envelope generator 16 in conjunction with FIG. 4.

Figure 5:
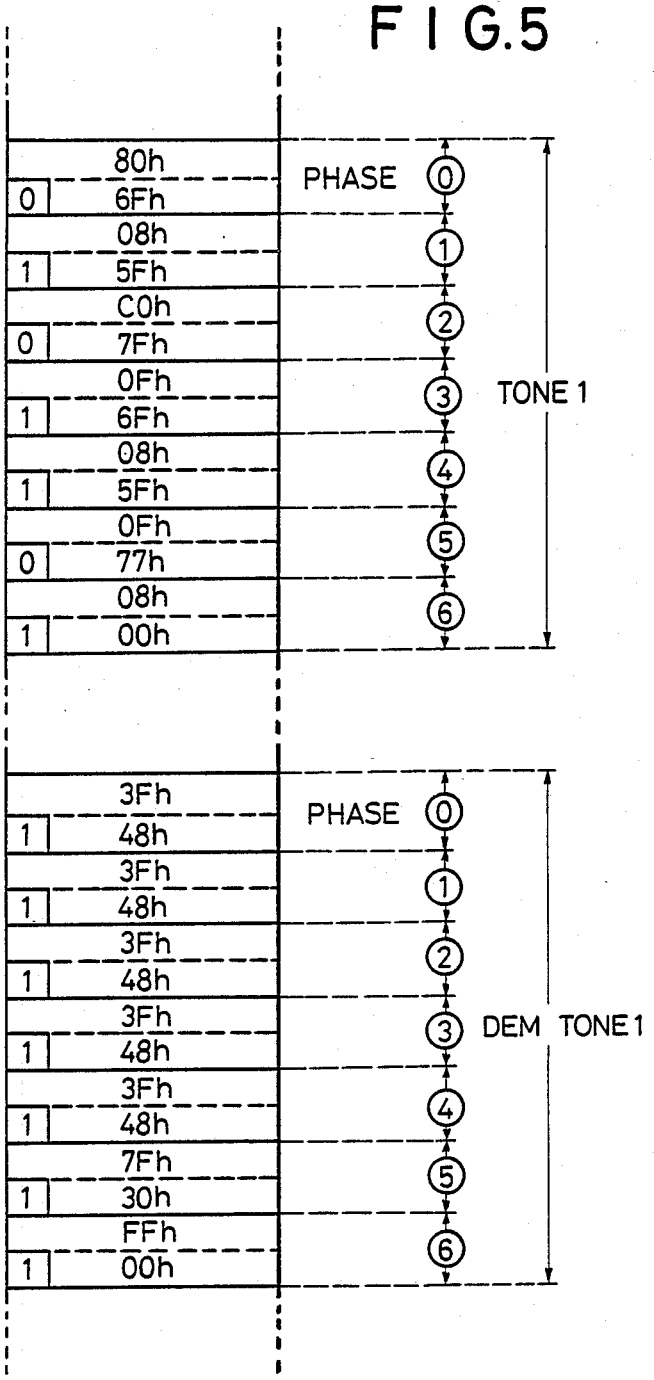

Now, let it be assumed that TONE 1 data and DEMTONE 1 data shown in FIG. 5 are being selected in the panel switch group 11. When the CPU 12*a* scans the state of the key switch group 10 via the address bus 13 and detects that a certain key is being depressed when all the tone generating channels are at the zero level, the CPU 12*a* once reads thereinto the depressed key data and then assigns it to a certain channel. In the current time slot of the channel the envelope generator 16 is supplied with note data and depressed/released key data (hereinafter referred to as key ON/OFF signal, which is identified as key OFF or ON depending on whether it is a "0" or "1") from the CPU 12*a* via the data bus 14. The note data and the key ON/OFF signal are latched in the DEM signal generator 22 by a timing signal $\phi_{DS}$ which is provided from the timing signal generator 20. The CPU 12*a* detects the state of the panel switch group 11 via the address bus 13 and, when the tone of TONE 1 has been selected as mentioned above, provides the TONE 1 data to the address controller 21 in the envelope generator 16 via the data bus 14. The address controller 21 latches therein the TONE 1 data by a timing signal $\phi_{AD}$ which is provided from the timing signal generator 20. At this time, since the envelope generator 16 is in its initial state, the DEM signal generator 22 applies a demand signal (hereinafter referred to as a DEM signal) 0 to the phase counter 23, the address controller 21 and the accumulator 24. Furthermore, the DEM signal generator 22 supplies the tone signal generator 15 with data NTD obtained after latching the afore-mentioned note data and the phase counter 23 with data KON "1" obtained after latching the key ON/OFF data. At this time, the phase counter 23 construes that a new key ON event has occurred, and provides 3-bit phase data "0" to the address controller 21. The address controller 21 receives the afore-mentioned data TONE 1 and the phase data "0" and generates and delivers via the address bus 13 to the RAM 12c an address for access to the memory area in which the desired data TONE "1" is stored. The RAM 12c provides the−/+signal "0", PEP data "6Fh" and SPD data "80h" of the phase (0) in the TONE 1 to the envelope generator 16 via the data bus 14. In the envelope generator 16 the phase counter 23 receives the−/+signal "0" and the PEP data "6Fh" and the accumulator 24 receives the−/+signal "0" and the SPD data "80h". Since the accumulator 24 is in its initial state, it is sending out SACC data "000h" which is an accumulated value of the SPD data. The phase counter 23 receives the SACC data "000h" and compares high-order seven bits "00h" of the SACC data and the PEP data "6Fh". Since the SACC data is smaller than the PEP data, an output CRS signal (which goes to a "1" when the SACC data and the PEP data cross each other) of the phase counter 23 remains in its initial state "0". The CRS signal is provided to the accumulator 2, wherein the SPD data "80h" is added to the SACC data "000h" when the CRS signal is a "0". Then the resulting SACC data "080h" is applied as envelope waveform data to the multiplier 17. As described above, the SPD data "80h" is accumulated until the SACC data becomes greater or equal to the PEP data and the CRS signal goes to a "1".

Next, a description will be given of the case where the phase proceeds from (0) to (1). Assume that the SACC data has reached "E00h" from "D80h" as a result of the accumulation of the SPD data "80h" mentioned above. At this time, high-order seven bit "70h" of the SACC data (a value by shifting "E00h" one bit position to right) and the PEP data "6Fh" are compared in the phase counter 23. The result of this comparison is that the SACC data is greater than or equal to the PEP data, and the CRS signal goes to a "1". When supplied with the CRS signal "1", the accumulator 24 stops further addition of the SPD data "80h" to the SACC data. Then, in the phase counter the current phase (0) is incremented to the phase (1). This phase data is provided to the address controller 21, from which an address for access to the memory area TONE 1 in which data of the phase (1) is delivered to the RAM 12c via the address bus 13. The RAM 12c provides SPD data "08h", PEP data "5Fh" and the−/+signal "1" (indicating the "−" direction) of the phase (1) in the TONE 1 to the envelope generator 16 via the data bus 14 in the same manner as in the case of the phase (0). In the envelope generator 16 the phase counter 23 receives the PEP data "5Fh" and the−/+signal "1" and the accumulator 24 receieved the SPD data "08h" and the−/+signal "1". The phase counter 23 compares the PEP data "5Fh" and high-order seven bits "70h" of the current SACC data. In this instance, the PEP data is smaller than the SACC data, but since the−/+signal is "1", the CRS signal goes to a "0", which is provided to the accumulator 24. The accumulator 24 responds to the−/+signal "1" to subtract the SPD data "08h" from the current SACC data "E00h". The resulting SACC data "DF8h" is applied as envelope waveform data to the multipler 17. In this way, the subtraction is continued until the PEP data becomes greater than or equal to the SACC data.

When the PEP data becomes greater than or equal to the SACC data, the CRS signal "1" is yielded and the phase proceeds from (1) to (2) in the same manner as in the phase shift from (0) to (1). Where the key ON state continues, the phase proceeds to (3), after which the phase shift is discontinued until the key ON state is switched to the key OFF state, and in this while the accumulator 24 continue to output a constant value of the SACC data at that time. This is what is called a sustain state. In such a case as mentioned above, the DEM signal generator 22 continues to output the DEM signal "0" while it is supplied with the most significant bit MSB of the phase data (hereinafter referred to as a phase MSB) and the same note. While this DEM signal remains at "0", the address controller 21 is accessible to the data of the TONE 1 area.

Next, a description will be given of a phase shift when the note of a certain depressed key is changed from the key ON state to the key OFF state. As described above, the current phase is (3), the SACC data is "DE3h", and envelope is in the sustain state. Here, the key ON/OFF signal goes from "1" to "0" and is provided to the DEM signal generator 22. As in the case of the key ON state the DEM signal generator 22 once latches the key ON/-OFF signal "0" and then applies the resulting signal KON "0" to the phase counter 23. By this, the phase is preset to (4) from (3) and the phase (4) is provided to the address controller 21 from the phase counter 23. At this time, since the DEM signal remains at "0", the address controller 21 applies, via the address bus 13, to the RAM 12c an address for access to the memory area of the phase (4) in the TONE 1. The RAM 12c receives the address and provides, via the data bus 14, to the envelope generator 16 SPD data "08h", PEP data "5Fh" and the−/+signal "1" of the phase (4) in the TONE 1. In the envelope generator 16, as in the case of the key ON state, the counter 23 receives the−/+signal "1" and the PEP data "5Fh", the accumulator 24 receives the −/+signal "1" and the SPD data "08h", and the phase counter 23 compares the PEP data "5Fh" and high-order seven bits "6Fh" of the current SACC data. In this instance, since the PEP data is smaller than the SACC data and since the−/+signal is "1", the CRS signal goes to a "0", which is applied to the accumulator 24. The accumulator 24 subtracts the SPD data "08h" from the current SACC data "DE3h" in accordance with the−/+signal "1". Then the SACC data "DDBh" is provided as envelope waveform data to the multiplier 17. In this way, the above subtraction is continued until the PEP data becomes greater than or equal to the SACC data. When the PEP data becomes greater than or equal to the SACC data, the CRS signal "1" is yielded, and the phase proceeds from (4) to (5). Thus, as long as key ON data is not newly assigned to the above-mentioned channel, the phase proceeds to the phase (6) and the tone generation is terminated with SACC data "000h" of the phase (6).

Figure 7:
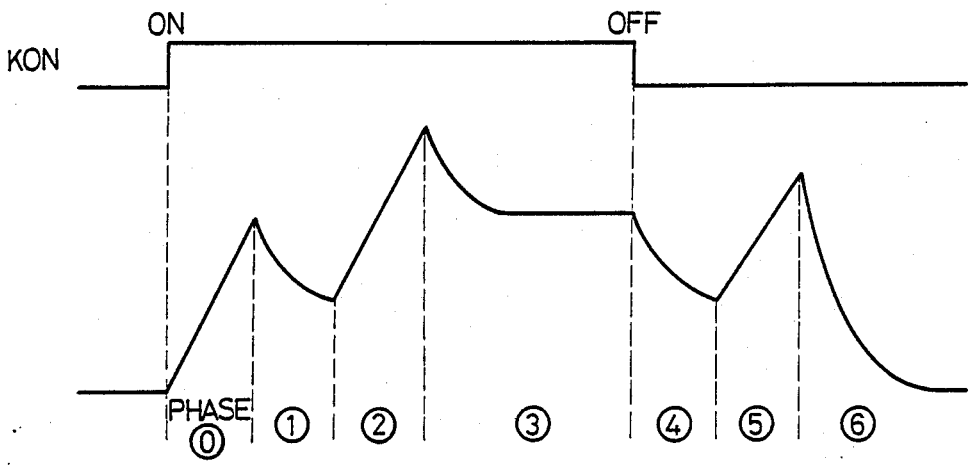
FIGS. 7, 8 and 9 are waveform diagrams, for explaining embodiments of the present invention.

The above is the operation of the envelope generator 16 from the time when a certain key is depressed in the state in which all the channel is at the zero level to the time when the key is released. FIG. 7 shows the envelope waveform which is produced in this case.

Figure 10A:
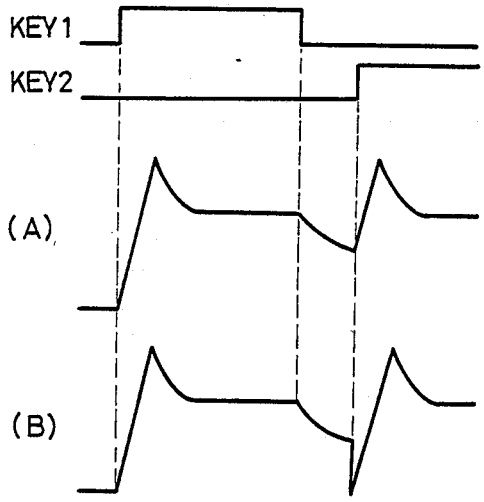
FIGS. 10A and 10B waveform diagrams, for explaining prior art examples.

Next, a description will be given of the operation of the present invention in the case where the high-speed release is needed. As referred to previously, when the high-speed release, that is, the so-called truncate processing is needed, there are two states shown in FIGS. 10A and 10B. The following will describe first the case where newly depressed key data is assigned to the channel assigned with previously depressed key data during a long release after the previous key is released as shown in FIG. 10A. Let it be assumed that the data TONE 1 is selected in the panel switch group 11 as in the above, and the data shown in FIG. 5 will be used in the following description.

Figure 8:
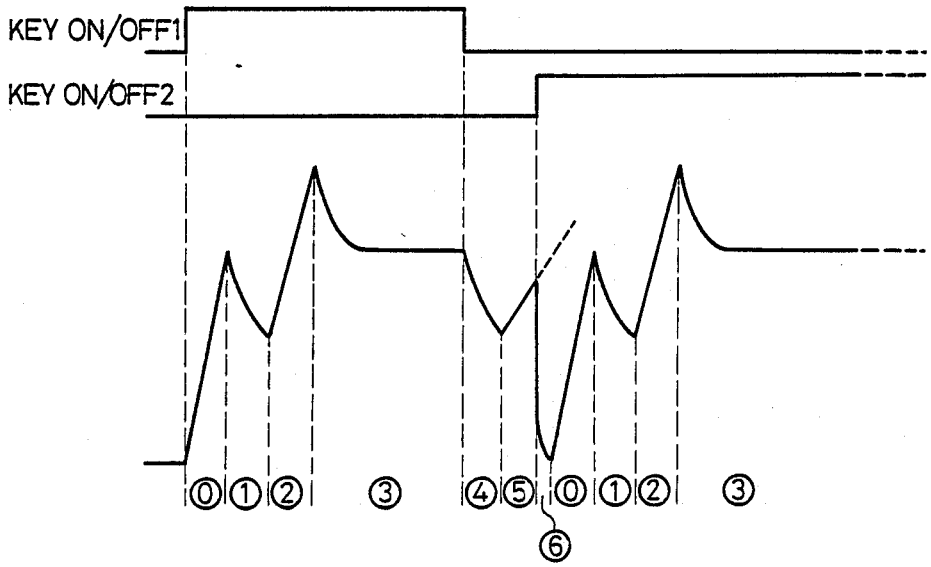

Now, assume that a new key depression occurs when the envelope waveform of the previous tone has proceeded to the phase (5) as shown in FIG. 8 and that SACC data of the current phase (5) is "CE0h". When the CPU 12*a* detects the new key depression in the key switch group 10 and assigns its depressed key data to this channel, the key ON/OFF signal "1" and note data are provided from the CPU 12*a* to the DEM signal 22 via the data bus 14. The DEM signal generator 22 is supplied with the MSB "1" of the current phase data from the phase counter 23 and the SACC data "CE0h" from the accumulator 24. The KON signal is a "0" and at this time the DEM signal goes to a "1", which is provided to the phase counter 23, the address controller 21 and the accumulator 24. When the DEM signal "1" is applied to the address controller 21, the address for access to the memory area of the phase (5) in the current TONE 1 is switched to the address for access to the area of the phase (5) in the DEMTONE 1, and the address is provided via the address bus 13 to the RAM 12*c*. The RAM 12*c* provides via the data bus 14 DEMSPD data "7Fh" in the DEMTONE 1 area to the accumulator 24, DEMPEP data "30h" to the phase counter 23, and a DEM−/+signal "1" to both of the phase counter 23 and the accumulator 24. The phase counter 23 compares the PEP data "30h" and high-order seven bits "5Fh" of the current SACC data. In this instance, the PEP data is smaller than the SACC data the−/+signal is "1"; so that the CRS signal goes to "0", which applied to the accumulator 24. The accumulator 24 responds to the−/+signal "0"to subtract the DEMSPD data "7Fh" from the current SACC data "CE0h", newly providing SACC data "C61g". In this way, the DEMSPD data "7Fh" is subtracted from the SACC data until the latter "600h" (30h for the high-order seven bits). At this time, since the DEMSPD data is as large as "7Fh", the release will be initiated at a speed higher than usual. When the SACC data becomes smaller than or equal to the DEMPEP data after repeated execution of the subtraction, the CRS signal goes to a "1", which is applied to the accumulator 24. The accumulator 24 responds to the CRS signal "1" to stop further subtraction of the DEMPEP data "7Fh" from the SACC data. In the phase counter 23 the current phase (5) is incremented to the phase (6). This phase data is sent to the address controller 21, but since the DEM signal is "1" at this time, the address controller 21 provides via the address bus 13 to the RAM 12*c* an address for access to the memory area DEMTONE 1 in which data of the phase (6) is sorted. The RAM 12*a* provides DEMSPD data "FFh", DEMPEP data "00h" and the−/+signal "1" in the DEMTONE 1 to the envelope generator 16. In the envelope generator 16 the phase counter 23 receives the DEMPEP data "00h" and the−/+signal "1" and the accumulator 24 receives the DEMSPD data "FFh" and the−/+signal "1". In the phase counter 23 the DEMPEP data "00h" and high-order seven bits "2Fh" of the current SACC data "5EEh". At this time, since the DEMPEP data is smaller than the SACC data and the−/+signal is "1", the CRS signal goes to a "0", which is applied to the accumulator 24. The accumulator 24 responds to the−/+signal "0" to subtract the DEMSPD data "FFh" from the current SACC data "5FFh". The resulting SACC data "500h" is provided as envelope waveform data to the multiplier 17. In this way, the above subtraction is performed until the DEMPEP data "00h" becomes equal to the high-order seven bits of the SACC data. When they become equal to each other, the CRS signal goes to a "1", by which further subtraction is stopped. At the same time, the phase also stops at the phase (6) and the DEM signal from the DEM signal generator 22 changes from "1" to "0". As a result of this, the note data NOTE of the newly depressed key and the corresponding key ON/OFF signal are latched in the DEM signal generator 22, from which they are output as NTD data and a KON signal. The DEM signal is applied to the phase counter 23, the accumulator 24 and the address controller 21. The phase counter 23 is preset to the phase (0) from the phase (6). The phase data (0) is provided to the address controller 24. The address controller 24 provides via the address bus 13 to the RAM 12*c* address data for access to data of the phase (0) in the TONE 1. The RAM 12*c* provides via the data bus 14 SPD data "80h" of the phase (0) in the TONE 1 to the accumulator 24, PEP data "6Fh" to the phase counter 23 and the−/+signal "0"to both of the phase counter 23 and the accumulator 24. The subsequent operations are the same as described previously. Thus the envelope depicted in FIG. 8 is generated.

As described above, in the case where a newly depressed key data is assigned to the channel assigned with previously depressed key data during the long release after the previously depressed key was released, when the KON signal "0" is output from the DEM signal generator 22, the key ON/OFF signal "1"is input thereinto. When the SACC data is not "000h" and the MSB of the phase data is a "1", the DEM signal "1" is yielded and the envelope generator 16 initiates the truncate operation while remaining in the current phase. When the SACC data becomes DEMPEP of the phase (6) and the truncate processing is finished and the DEM signal goes to a "0", the KON signal also goes to a "1" and the phase is also reset to (0), this channel newly enters the attack state.

Figure 10B:
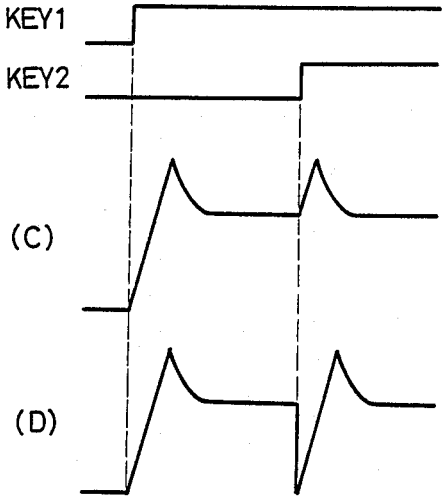

Next, a description will be given of the case where newly depressed key data is assigned to a channel in which the key of the previous tone is still being depressed as shown in FIG. 10B. This will be described using the data depicted in FIG. 5 on the assumption that the data TONE 1 is selected in the panel switch group 11 as in the above case.

Figure 9:
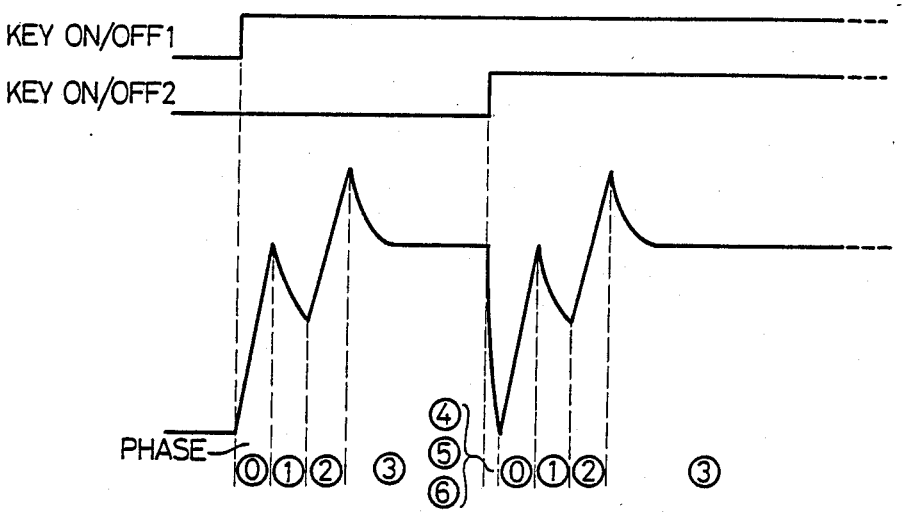

Now, let it be assumed that the envelope waveform has proceeded to the phase (3), that current SACC data is "DE0h", and that the channel in which the key of the previous tone is being still depressed is in the sustain state, as shown in FIG. 9. When the CPU 12*a* detects the occurence of a new key depression and assigns the depressed key data to the above channel, the key ON/-OFF signal "1" and new tone data are sent from the CPU 12*a* to the DEM signal generator 22 via the data bus 14. The DEM signal generator 22 is supplied with the MSB "0" of the current phase from the phase counter 23 and SACC data "DE0h" from the accumulator 24. The data NTD at this time is the previous NTD data. In this state the DEM signal goes to a "1", which is applied to the phase counter 23, the address controller 21 and the accumulator 24. The address controller 21 responds to the DEM signal "1" to switch the address for access to the memory area of the phase (3) in the current TONE 1 to an address for access to data of the phase (3) in the DEMTONE 1 area. This address is sent to the RAM 12*c* via the address bus 13. The RAM 12*c*, supplied with the address, provides via the data bus 14 DEMSPD data "3Fh" of the phase (3) in the DEMTONE 1 area to the accumulator 24, DEMPEP data "48h" to the phase counter 23 and DEM−/+signal "1" to both of the phase counter 23 and the accumulator 24. Next, the phase counter 23 compares the DEMPEP data "48h" and high-order seven bits "6Fh" of the current SACC data. Since the PEP data is smaller than the SACC data and since the−/+signal is "1", the CRS signal goes to a "0", which applied to the accumulator 24. The accumulator 24 responds to the CTS signal "0" to subtract the DEMSPD data "3Fh" from the current SACC data "DE0h", by which the latter becomes "DAlh". In this way, the DEMSPED data "3Fh" is subtracted from the SACC data until the latter becomes "900h" ("48h" for high-order seven bits). In this case, since the DEMSPED data is as large a value as "3Fh", the high-speed release is conducted at a speed higher than usual, as shown in FIG. 9. The phase at this time is (3). When the SACC data becomes smaller than or equal to the PEP data as a results of repeated subtraction, the CRS signal goes to a "1", which is applied to the accumulator 24, causing it to stop further subtraction of the DEMSPED data "3Fh" from the SACC data. In the phase counter 23 the current phase (3) is incremented to the phase (4). This phase data is provided to the address controller 21, but since the DEM signal is "1" at this time, the address controller 21 provides via the address bus 13 to the RAM 12*c* an address for access to the memory area of the area DEMTONE 1 in which data of the phase (4) is stored. The RAM 12*a* provides via the data bus 15 DEMPEP data "48h" of the phase (4) in the DEMTONE 1 and the−/+signal "1" to the phase counter 23 and DEMSPD data "3Fh" and the−/+signal "1" to the accumulator 24. The phase counter 23 compares the DEMPEP data "48h" and high-order seven bits "47h" of current SACC data "3EAh". At this time, since the−/+signal is "1"and since the PEP data is greater than or equal to the SACC data, the CRS signal goes to a "1" and the phase (4) is incremented to the phase (5). Accordingly, no operation is conducted in the phase (4), and the phase proceeds to the phase (5). This phase data is sent to the address controller 21, but since the DEM signal is "1" at this time, an address for access to the memory area of the DEMTONE 1 in which data of the phase (5) is stored is sent to the RAM 12*c* via the address bus 13. The RAM 12*c* provides via the data bus 14 DEMPEP data "30h" of the phase (5) in the DEMTONE 1 and the−/+signal "1" to the phase counter 23 and DEMSPD data "7Fh" and the−/+signal "1" to the accumulator 24. In the phase counter 23 the DEMPEP data "30h" and high-over seven bits "47h" of the current SACC data "8EAh" are compared. At this time, since the−/+signal is "1" and since the PEP data is smaller than or equal to the SACC data, the CRS signal goes to a "0", which is applied to the accumulator 24. The accumulator 24 responds to the CRS signal "0" to subtract the DEMSPD data "7Fh" from the current SACC data "8EAh", providing new SACC data "86Bh". In this way, the DEMSPD data "7Fh" is repeatedly subtracted from the SACC data until the latter becomes "600h"("30h" for high-order seven bits). In this instance, since the DEMSPED data is as large a value as "7Fh", the high-speed release is effected at a speed higher than usual. When the SACC data becomes smaller than or equal to the PEP data, the CRS signal goes to a "1", which is applied to the accumulator 24. Upon receipt of the CRS signal "1"the accumulator 24 stops further subtraction of the DEMSPED data "7Fh" from the SACC data. In the phase counter 23 the current phase (5) is incremented to the phase (6). This phase data is sent to the address controller 21, but since the DEM signal is "1" at this time, the address controller 21 provides via the address bus 13 to the RAM 12*c* an address for access to the memory area of the DEMTONE 1 in which data of the phase (6) is stored. The RAM 12*c* provides via the data bus 14 DEMSPD data "FFh" in the DEMTONE 1 and the−/+signal "1" to the accumulator 24 and DEMSPD data "00h" and the −/+signal "1" to the phase counter 23. In the phase counter 23 the DEMPEP data "00h" and high-order seven bits "2Fh" of current SACC data "5F0h" are compared. At this time, since the DEMPEP data is smaller than or equal to the SACC data and since the−/+signal is "1", the CRS signal goes to a "0", which is provided to the accumulator 24. The accumulator 24 responds to the CRS signal "0" to subtract the DEMSPD data "FFh" from the current SACC data "5F0h", providing new SACC data "4F1h". This SACC data "4F1h" is provided as envelope waveform data to the multiplier 17. In this way, the above-mentioned subtraction is repeatedly carried out until the DEMPEP data ("00h") becomes equal to the high-order seven bits of the SACC data. When they become equal to each other, the CRS signal goes to "1", stopping further subtraction and the phase increment in the phase (6). The DEM signal from the DEM signal generator 22 changes from a "1"to "0". As a result of this, the DEM signal generator 22 latches the note of the newly depressed key and the corresponding key ON/OFF signal and outputs them as new NTD data and a new KON signal. The DEM signal "0" is applied to the phase counter 23, the accumulator 24 and the address controller 21. The phase counter 23 is preset to the phase (0) from the current phase (3). The phase data (0) is provided to the address controller 21, from which address data for access to data of the phase (0) in the TONE 1 is provided via the address bus 13 to the RAM 12*c*. Based on the address data the RAM 12*c* provides via the data bus 14 SPD data "80h" of the phase (0) in TONE 1 to the accumulator 24, PEP data "6Fh" to the phase counter 23 and the −/+signal "0" to both of them. The subsequent operation is the same as described previously. As described above, in the case where newly depressed key data is assigned to a selected one of the channels of the system all of which are being in the key ON state, when the KON signal from the DEM signal generator 22 is a "1" and the previous NTD data differs from new note data and SACC data is not "000h" and, further, the MSB of the phase data is a "0", the DEM signal "1" is yielded. By this, the envelope generator 16 initiates the truncate operation in the current phase, and the phase proceeds to (6). When the SACC data becomes "000h", the truncate processing is completed and the DEM signal goes to a "0". Then, the NTD data becomes the new tone data and the phase is also set to (0), thus newly entering in the attack state.

While in the above embodiment the data assignment is performed by software using a microcomputer, it is a matter of course that the assignment can also be achieved by logical hardware.

As described above, according to the present invention, the truncate processing prevents the generation of a new tone before the envelope waveform of the previous tone is finished, but permits the tone generation after the volume of the previous tone is sufficiently diminished, ensuring the tone generation with a satisfactory feeling of attack. Further, since the envelope waveform of the previous tone is not abruptly interrupted and cleared in a moment but is decayed at a constant and high speed, the generation of noise such as a click can be avoided. Moreover, since demanded speed data is provided for each tone, it is possible to generate respective tones not at a demanded speed like the least common multiple but at an optimum speed for each tone and to make the previous tone generation proceed to the next tone generation without producing noise such as a click.

It will be apparent that many modifications and variations may be effected without departing from the scope of the novel concepts of the present invention.

What is claimed is:

1. An electronic musical instrument comprising:

an envelope generator which utilizes a phase splitting system whereby individual envelopes of respective tones of a plurality of tones are split into plurality of phases on the time base, each phase being represented by phase data composed of speed data (SPD), phase end value data (PEP) and −/+flag data wherein the −/+flag data is a binary signal representative of attack or decay, each tone including demanded phase data composed of demanded speed data (DEMSPD), demanded predetermined end value data (DEMPEP) and demanded −/+-flag data wherein the demanded −/+signal is a binary signal representative of attack or decay for each demanded phase, key data being generated in response to a key depression and assigned to tone generating channels smaller in number than the total number of keys, the envelope generator including:

a high-speed release demand signal generator for generating a high speed release demand signal when a new tone is assigned to a tone generating channel which is in operation for generating a previous tone, for switching speed data in the phase of the previous tone to demanded speed data in the same phase, releasing the envelope of the previous tone at a high speed, for comparing the level of the phase of the previous tone with the demanded predetermined phase end value data (DEMPEP) and for terminating the high-speed release demand signal upon detection that the level of the envelope of the previous tone phase drops below the demanded predetermined phase end value data (DEMPEP) and for reading thereinto the key data of the new tones; and, a phase counter which, upon the high speed release demand signal being turned off causes the tone generating channel to proceed from the phase of the previous tone to a first, attack phase of the new tone.

2. An electronic musical instrument according to claim including a CPU which performs key assignments, an envelope calculating circuit for generating an envelope waveform, said CPU writing on a RAM connected to a CPU data bus at least a key ON/OFF signal and the speed data (SPD), the predetermined phase end value (PEP), the −/+flag data and its corresponding −/+signal, the demanded speed data (DEMSPD), the demanded predetermined phase end data (DEMPEP) and the demanded −/+flag data and its corresponding demanded −/+signal which are envelope parameters; the envelope calculating circuit reads out the key ON/OFF signal and the envelope parameters from the RAM and performs a periodic calculation to generate an envelope, the envelope is multiplied by the output of a note generator; and the multiplied output is provided via a D-A converter to a sound system for reproduction.

* * * * *